US011577375B2

(12) United States Patent
Chambers et al.

(10) Patent No.: US 11,577,375 B2
(45) Date of Patent: Feb. 14, 2023

(54) ELECTRIC CARPET STAPLER WITH ELECTRONIC SENSOR SWITCH

(71) Applicant: Crain Cutter Company, Inc., Milpitas, CA (US)

(72) Inventors: Gregory Joseph Chambers, Morgan Hill, CA (US); Tan Dinh Nguyen, Milpitas, CA (US)

(73) Assignee: Crain Cutter Company, Milpitas, CA (US)

( * ) Notice: Subject to any disclaimer, the term of this patent is extended or adjusted under 35 U.S.C. 154(b) by 100 days.

(21) Appl. No.: 16/904,040

(22) Filed: Jun. 17, 2020

(65) Prior Publication Data

US 2021/0394347 A1 Dec. 23, 2021

(51) Int. Cl.
*B25C 5/15* (2006.01)
*B25C 5/16* (2006.01)

(52) U.S. Cl.
CPC ..... *B25C 5/15* (2013.01); *B25C 5/161* (2013.01)

(58) Field of Classification Search
CPC ..... B25C 5/15; B25C 5/161
See application file for complete search history.

(56) References Cited

U.S. PATENT DOCUMENTS 3,141,171 A * 7/1964 Doyle ..... B25C 1/06 335/255
3,209,180 A * 9/1965 Doyle ..... B25C 1/06 335/238
3,434,026 A * 3/1969 Doyle ..... B25C 1/06 327/461
3,662,190 A * 5/1972 Naber ..... H02K 33/00 327/365
3,924,789 A * 12/1975 Avery ..... B25C 1/06 227/132
4,946,087 A * 8/1990 Wingert ..... B25F 5/02 227/156
6,971,567 B1 * 12/2005 Cannaliato ..... B25C 1/06 173/205
10,627,375 B2 * 4/2020 Robson ..... H01J 49/0431
2010/0038397 A1 * 2/2010 Krondorfer ..... B25C 1/06 227/8
2012/0286014 A1 * 11/2012 Pedicini ..... B25C 1/04 227/4

* cited by examiner

*Primary Examiner* — Thomas M Wittenschlaeger
*Assistant Examiner* — Katie L Gerth
(74) *Attorney, Agent, or Firm* — Fenwick & West LLP

(57) ABSTRACT

An electric carpet stapler comprises a trigger and switch assembly that has an actuation caused by a change of state of a sensor, which causes the sensor to send a signal to a control circuit to begin a process to supply power to a winding. The trigger and switch assembly includes a trigger that moves in a trigger actuation direction to move a sensor actuator in a sensor actuation direction, causing a change of state in the sensor, which causes the control circuit to begin the process to supply power to the winding. The trigger and switch assembly may also include a toggle. At the actuation of the trigger and switch assembly, the toggle creates a mechanical instability, and a toggle signal to the user, which may be produced mechanically.

21 Claims, 6 Drawing Sheets

Prior Art

ELECTRIC CARPET STAPLER WITH ELECTRONIC SENSOR SWITCH

BACKGROUND

An electric carpet stapler is an electrically-powered tool for stapling carpet to wooden subfloor surfaces to prevent the carpet from moving, particularly on staircases. U.S. Pat. No. 3,209,180 to Doyle describes a prior art electric carpet stapler which includes an operating winding, an armature attached to a fastener driving element, an armature return spring, a switch, and a control circuit. In various ways, a switch like Doyle's may be used to produce a trigger signal to a control circuit, or to temporarily provide mains power to a control circuit. After being triggered, the control circuit begins a process that supplies power to the operating winding to magnetically actuate the armature. Examples of prior art control circuits are described in U.S. Pat. No. 3,141,171 to Doyle, U.S. Pat. No. 3,434,026 to Doyle, U.S. Pat. No. 3,662,190 to Naber, and U.S. Pat. No. 3,924,789 to Avery.

In the device of U.S. Pat. No. 3,209,180 to Doyle, as shown in FIG. 1, staples are sequentially supplied by a magazine assembly 28 into a drive track 24 of a nosepiece 26. The nosepiece 26 is narrow and able to penetrate the rows of carpet tufts down to the carpet backing, which is stapled to the subfloor surface. When the winding 16 is energized, the armature 20 and driver blade 22 are accelerated rapidly downward to drive the staple. After driving the staple, return spring 30 returns armature 20 and driver blade 22 to their normal position, ready for the next driving action.

To produce a trigger signal for a control circuit, trigger 80 is pulled, which through a series of actions results in switch operator 38a of switch 38 being depressed. Switch 38 is generally a "snap action" microswitch, which is mechanical and quite small in size, and which can fit in the handle 12 along with the control circuit (not shown). However, as shown in FIG. 5 herein, the mechanical components in the prior art microswitch 200 are quite small and delicate. The extreme recoil and vibration produced in the electric carpet stapler as it drives the staple into a subfloor can damage the microswitch. For that reason, replacement of microswitches is frequently required maintenance for existing electric carpet staplers.

Existing control circuits for an electric carpet stapler have generally depended on a mechanical microswitch that is separate from the control circuit element itself to cause the control circuit to supply power to the winding. In one design, when mains power is connected, power is supplied to the control circuit. The microswitch, which is wired to the control circuit, switches a lower voltage signal, which when in the closed condition signals the control circuit to begin a process to supply power to the winding. Since the electric carpet stapler is designed to operate on alternating current electricity available in homes, the control circuit is generally programmed to delay sending a control signal to a gate or SCR ("silicon-controlled rectifier") until a zero crossing of the alternating current, at which time it supplies power to the winding.

To further describe the functions of the trigger assembly of a prior art electric carpet stapler, it generally has included a pivoting trigger, a trigger return spring, and the prior art microswitch. When the trigger is first pulled by a user, to prevent unwanted actuation, the trigger will pivot from a starting position and bias a trigger return spring before causing the microswitch to close, a process that will be referred to as "pre-actuation." After the pre-actuation, the "actuation" occurs as the microswitch closes, which creates a signal to the control circuit to begin a process to supply power to the winding. At or just after the actuation, the assembly may mechanically produce a palpable signal to the user or "click" that indicates the point in the trigger's motion that corresponds to the actuation. The click signal is often produced by the mechanical microswitch at about the time it closes. This can be helpful for training the user to use the electric carpet stapler, when the stapler is preferably not connected to power. After the actuation, a "post actuation" permits further travel of the trigger in the pulling direction, conforming to the natural motion of the trigger finger, and eliminating an unergonomic hard stop. At any point after the trigger is first pulled by a user, a "reset" of the assembly involves the return of the trigger to its starting position, normally by the trigger return spring, and the opening of the microswitch.

Beyond producing the actuation, the design of the trigger assembly should ensure that, for any one pulling of the trigger, at most one actuation can possibly occur. In existing trigger assemblies, this is partly ensured by the single acting "over center" closing action of microswitch. It is also ensured by the action of the trigger return spring, which ensures that the trigger once released will only rotate back to the trigger starting position, preventing the microswitch from closing again on its own.

To reduce maintenance costs for the prior art electric carpet stapler related to the microswitch, it would be desirable to provide a more durable trigger and switch assembly, which could still perform the functions of the prior art trigger assembly, microswitch, and control circuit.

SUMMARY

Embodiments of the invention include an electric carpet stapler that comprises a trigger and switch assembly that has an actuation caused by a change of state of a sensor, which causes the sensor to send a signal to a control circuit to begin a process to supply power to a winding. In one embodiment, the trigger and switch assembly includes a trigger that moves in a trigger actuation direction to move a sensor actuator in a sensor actuation direction, causing a change of state in the sensor comprising a change from a sensor signal-on state to a sensor signal-off state, which causes the control circuit to begin the process to supply power to the winding. In another embodiment, the change of state of the sensor comprises a change from a sensor-signal-off state to a sensor signal-on state, which causes the control circuit to begin the process to supply power to the winding.

In one embodiment, the trigger and switch assembly includes a trigger that moves a sensor actuator comprising a slider, a sensor comprising a photo sensor, and the control circuit. The photo sensor includes a light emitter comprising a light emitting diode that emits infrared light and a light sensor that comprises a silicon photo transistor. As the trigger is pulled, it moves the slider to permit or prevent the infrared light from passing to the silicon photo transistor. In one embodiment of the control circuit, when light contacts the silicon photo transistor, the silicon photo transistor behaves as a switch that closes to conduct to ground. This causes the voltage on a conductor to the control circuit to drop to near-zero, which is referred to herein as a sensor signal-off signal. When the control circuit detects the sensor signal-off signal, it begins the process to supply power to the winding. Afterwards, when the trigger is released, the slider prevents light from contacting the silicon photo transistor. This causes the photo sensor to behave like a switch that opens to cause a sensor sensor-on signal, which increases the voltage on the conductor to the control circuit and thereby resets the control circuit to receive a next sensor signal-off signal.

In an alternative embodiment of the control circuit, when the slider permits light to pass to the silicon photo transistor, the silicon photo transistor conducts creating a signal on the conductor to the control circuit comprising an increase in voltage to signal the control circuit to begin a process to supply power to the winding.

In one embodiment, the trigger and switch assembly includes a trigger that moves from a trigger starting position in a trigger actuation direction to move a sensor actuator comprising a slider, and a sensor comprising a photo sensor that senses the passing of light from a light emitter to a light sensor. In one embodiment, the slider includes a slider aperture, and the motion of the trigger in the trigger actuation direction moves the slider in a slider actuation direction moving the slider aperture to permit light to pass from the light emitter of the photo sensor to the light sensor, causing a change of state of the photo sensor, from a sensor signal-on state to a sensor signal-off state, which signals the control circuit to begin the process to supply power to the winding. The point at which the trigger has moved far enough in the trigger actuation direction to move the slider aperture far enough to permit light to pass from the light emitter of the photo sensor to the light sensor is referred to as the trigger point of actuation. The point at which the trigger is stopped from moving any further in the trigger actuation direction at the end of the post-actuation is referred to as the trigger stop. In one embodiment, the slider aperture has a length permitting light to pass from the light emitter of the photo sensor to the light sensor in the entire travel of the slider as it is moved by the trigger from the trigger point of actuation to the trigger stop.

In another embodiment, the trigger and switch assembly includes a trigger, a photo sensor, and a sensor actuator comprising a slider, and the trigger instead moves the slider to prevent light from passing from the light emitter of the photo sensor to the light sensor, causing the change of state of the photo sensor which signals the control circuit to begin a process to supply power to a winding.

In another embodiment, the trigger and switch assembly comprises a trigger that moves a slider, and the slider moves in a horizontal axis of the handle portion of the electric carpet stapler. In another embodiment, the photo sensor includes an opening for the slider in the horizontal axis of the handle. In another embodiment, the photo sensor is positioned in a portion of the control circuit proximate the trigger.

In another embodiment, the trigger and switch assembly includes a trigger that moves a sensor actuator, a sensor, and a toggle. At the actuation of the trigger and switch assembly, the toggle creates a mechanical instability, requiring the trigger to move either towards the trigger stop, or towards the trigger starting position, but will not allow it to remain at the trigger point of actuation. In one embodiment, at the actuation, the change of state in the sensor caused by the sensor actuator happens at the same point that the mechanical instability occurs in the trigger and switch assembly. In one embodiment, at or shortly after the actuation, the toggle creates a toggle signal to the user. In one embodiment, the toggle signal is produced mechanically.

In one embodiment, the trigger and switch assembly includes a trigger, a sensor actuator comprising a slider, a photo sensor, and a toggle comprising a point on the slider that contacts another point on the trigger and switch assembly. In one embodiment, the toggle comprises a rounded projection on the slider which comes into contact with an apex of a circular ball, and a ball spring that is biased as the ball is moved. A pulling motion of the trigger by a user from the trigger starting position produces motion of the slider in a pulling direction, causing the rounded projection of the slider to contact the ball, which lifts the ball up a leading section of the rounded projection, and which biases the ball spring. At the actuation, an unstable point-to-point contact between the apex of the rounded projection of the slider and the apex of the ball produces the mechanical instability. In one embodiment, at the actuation, the mechanical instability between the rounded projection of the slider and the ball occur at the same time that the slider changes the state of the sensor to cause the control circuit to begin a process to supply power to a winding.

In one embodiment, the trigger and switch assembly comprises a trigger that moves a slider having a slider aperture, a trigger return spring, a photo sensor, a control circuit, and a toggle comprising a rounded projection on the slider, a ball, and a ball spring. When the trigger is pulled and moves from the trigger starting position, the trigger return spring is biased to return the trigger to a trigger starting position. After the trigger is pulled in a trigger actuation direction far enough to move the slider aperture to permit light to pass from the light emitter of the photo sensor to the light sensor to cause the control circuit to begin a process to supply power to the winding, the apex of the rounded projection of the slider is in an unstable point-to-point contact with the apex of the ball and produces the mechanical instability. At this mechanical instability, the trigger is required to move either by being further pulled in the trigger actuation direction by a user towards the trigger stop, and in such case the slider aperture has a length permitting light to continue to pass as it is pulled by the trigger to the trigger stop, or else the trigger if released is required to return to the trigger starting position due the bias of the return spring, which moves the slider aperture to prevent light from passing from the light emitter of the photo sensor to the light sensor. When light is prevented from passing to the light sensor, this causes a change of state of a photo sensor which resets the control circuit for the next process to supply power to the winding. In the pre-actuation, whether the trigger is pulled or released, there will also be no change in state of the photo sensor, because the slider will not have moved enough to permit light to pass. For these reasons, any pulling of the trigger by a user should cause the control circuit to begin a process to supply power to winding one time only.

In one embodiment, instantaneously after the actuation, continued pulling motion of the trigger pulls the slider which permits the ball to move down a steep trailing section of the rounded projection, causing the ball to be accelerated by the ball spring to impact a surface, creating a toggle signal comprising a click that is produced mechanically. In one embodiment, when the electric carpet stapler is not connected to power, if the trigger is pulled, the mechanical click is an indication to a user that the actuation would occur at about the time of the click.

In one embodiment of the trigger and switch assembly, after the trigger is pulled from a trigger starting position, to any point in the pre-actuation, actuation, or post-actuation, a subsequent reverse motion of the trigger in a trigger reset direction is referred to as a reset. In one embodiment, if in the reset the trigger moves from the actuation or post-actuation to the pre-actuation, the trigger moves the sensor actuator to cause another change of state in the sensor comprising a change from a sensor signal-off state to a sensor signal-on state, and the sensor signal-on state sends a signal to the control circuit that resets it to receive a next sensor signal-off signal to supply power to the winding. In another embodiment, the change of state of the sensor is from a sensor signal-on state to a sensor signal-off state, which resets the control circuit to receive a next signal-on signal to supply power to the winding.

In one embodiment, during a reset after an actuation, the trigger is moved in a trigger reset direction towards a trigger starting position. This causes a slider having a slider aperture to move in a slider reset direction and thereby prevents light from passing from the light emitter of the photo sensor to the light sensor. This also causes another change of state of a photo sensor comprising a sensor signal-on state, resetting the control circuit to receive a next sensor signal-off signal to supply power to the winding. In another embodiment, the slider moves in the slider reset direction to permit light to pass from the light emitter of the photo sensor to the light sensor, causing the change of state of the photo sensor to reset the control circuit to receive a next signal to supply power to the winding.

In one embodiment, the trigger and switch assembly further includes a trigger return spring that is biased after the trigger is pulled to return the trigger in the trigger reset direction to a trigger starting position of the pre-actuation. In one embodiment, at the starting position of the pre-actuation, the rounded projection of the slider no longer contacts the ball.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
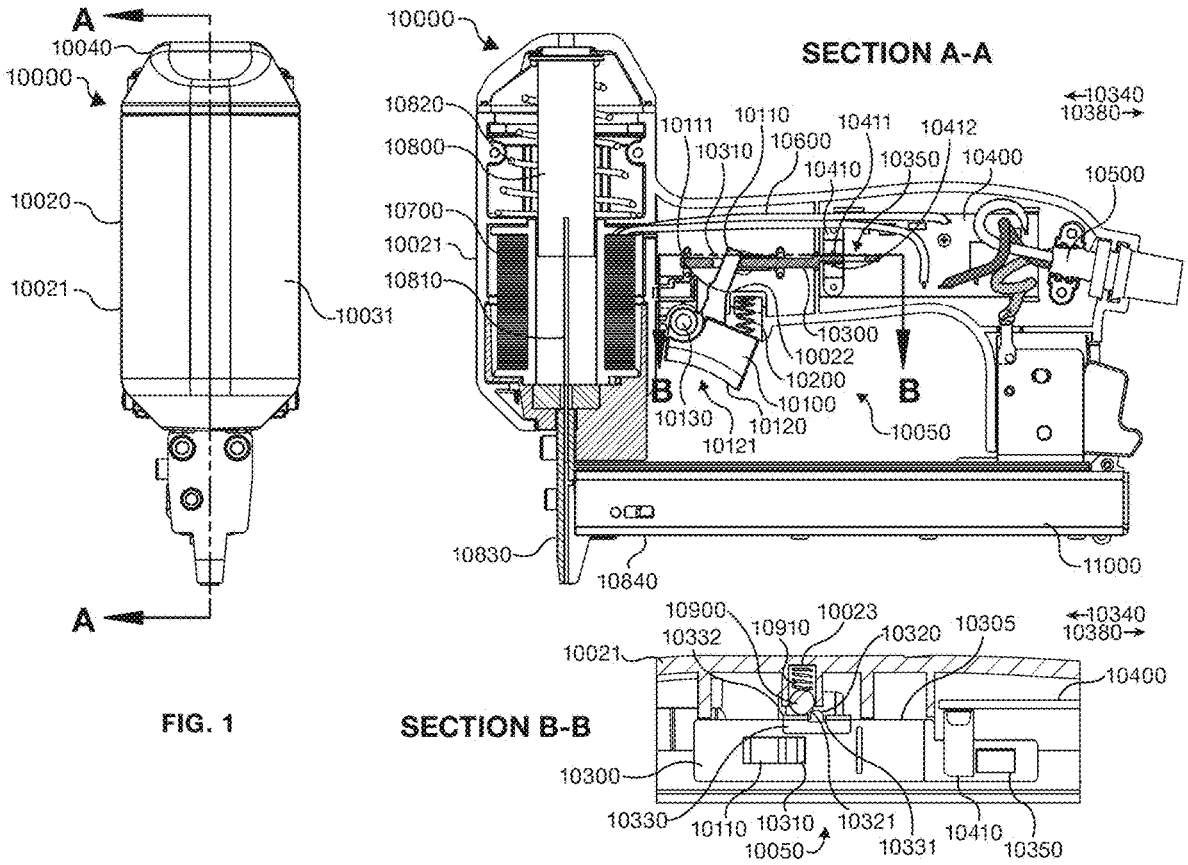
FIG. 1 is a diagram and partial section views of an electric carpet stapler at the pre-actuation, with the trigger at a trigger starting position, in accordance with an embodiment of the invention.

FIG. 1 shows an end view of an electric carpet stapler 10000 that includes a plastic housing 10020 formed in a left half 10021 and right half 10031, and an aluminum cap 10040. Section A-A is taken at about the centerline between left half 10021 and right half 10031. Section A-A shows that electric carpet stapler 10000 internally includes a trigger 10100, a trigger return spring 10200, a slider 10300, control circuit 10400, alternating current mains wires 10500, winding supply wires 10600, winding 10700, armature 10800 which is connected to a staple driver blade 10810, and armature return spring 10820. In Section A-A, trigger 10100 is at a trigger starting position 10121 at the beginning of the pre-actuation. Trigger 10100 includes a trigger arm 10110 that extends through a trigger arm opening 10310 in slider 10300. When trigger 10100 is pulled as by pressure from the user's finger at trigger surface 10120, trigger 10100 will rotate counter-clockwise on pivot 10130, causing trigger arm 10110 to rotate counter-clockwise, and causing slider 10300 to be pulled in a pulling direction connoted by arrow 10340.

As shown in Section A-A of FIG. 1, trigger 10100, trigger return spring 10200, slider 10300, metal sleeve 10330 (Section B-B), control circuit 10400, ball 10900 (Section B-B) and ball spring 10910 (Section B-B) comprise the main components of a trigger and switch assembly 10050 for the electric carpet stapler 10000. In the embodiment of Section A-A, photo sensor 10410 is a component of control circuit 10400. In alternative embodiments, photo sensor 10410 could be part of a circuit separate from control circuit 10400. Section A-A also shows that trigger 10100 is at a trigger starting position 10121 with a back side 10111 of a trigger arm 10110 against a trigger start surface 10022 (a feature of housing left half 10021).

Figure 4:
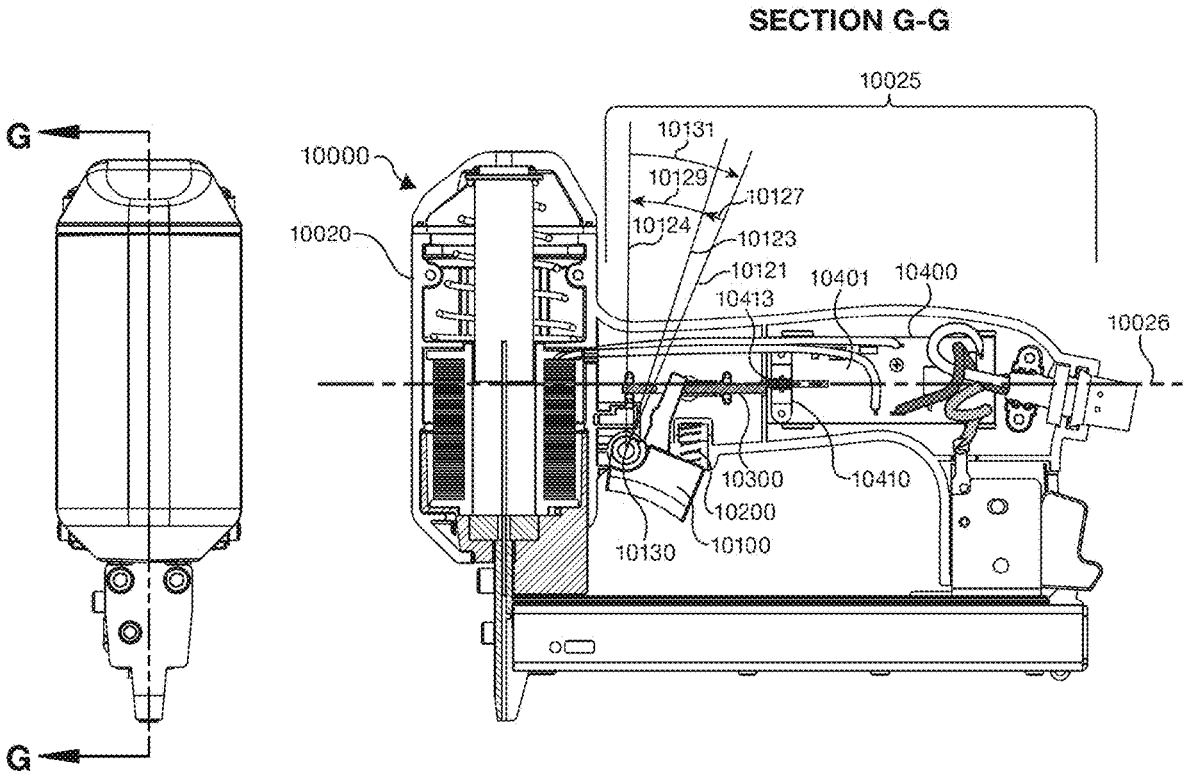
FIG. 4 is a diagram and partial section view of the electric carpet stapler of FIG. 4 showing the motion of trigger 10100, in accordance with an embodiment of the invention.

Section G-G of FIG. 4 provides an introduction to the motion of trigger 10100 and how its positions correspond to different functions of the trigger and switch assembly. Trigger 10100 has a trigger starting position 10121, a trigger point of actuation 10123, and a trigger stop position 10124. As used herein to describe embodiments of the present invention, the following terms are defined as follows: the pre-actuation is the arc 10127 from the trigger starting position 10121 to just before the trigger point of actuation 10123. The actuation is at trigger point of actuation 10123. The post-actuation is the arc 10129 from just after the trigger point of actuation 10123 to the trigger stop position 10124. Arc 10131 connotes the reset. At any point in the arc 10131 from just after trigger starting position 10121 to the trigger stop position 10124, if the trigger is released, a reset of the trigger and switch assembly occurs, with the trigger return spring 10200 moving trigger 10100 back to the trigger starting position 10121. As used herein, with regards to the motion of the trigger, the phrase "past the trigger point of actuation," means continuing motion of the trigger after the trigger point of actuation 10123 that is in a direction away from the trigger starting position 10121, but not necessarily to a trigger stop position 10124, as some embodiments do not include a trigger stop, such as trigger stop 10024 (Section C-C of FIG. 2).

Referring back to FIG. 1, Section B-B of Section A-A shows trigger and switch assembly 10050 from the top of slider 10300 and shows rounded projection 10320 in relation to a ball 10900 and ball spring 10910 in the beginning of the pre-actuation. Ball 10900 and spring 10910 are held in an opening 10023 formed in left half 10021 of plastic housing 10020 (FIG. 1). Attached to slider 10300 is a metal sleeve 10330, which is formed as a u-shaped channel fitting onto an inner side 10305 of slider 10300. Metal sleeve 10330 includes a slot 10331 for rounded projection 10320 to extend through. As slider 10300 is a small and complex shape, it is preferred to form it as a plastic molding. Metal sleeve 10330 mainly serves to protect slider 10300 from wear from ball 10900, but also has a hardness that increases a click sound created by being impacted by ball 10900, as described below in the discussion of the post-actuation.

In the beginning of the pre-actuation, as shown in Section B-B, ball 10900 is not in contact with rounded projection 10320, but rests against an outer forward surface 10332 of metal sleeve 10330. During the pre-actuation, as trigger

Figure 2:
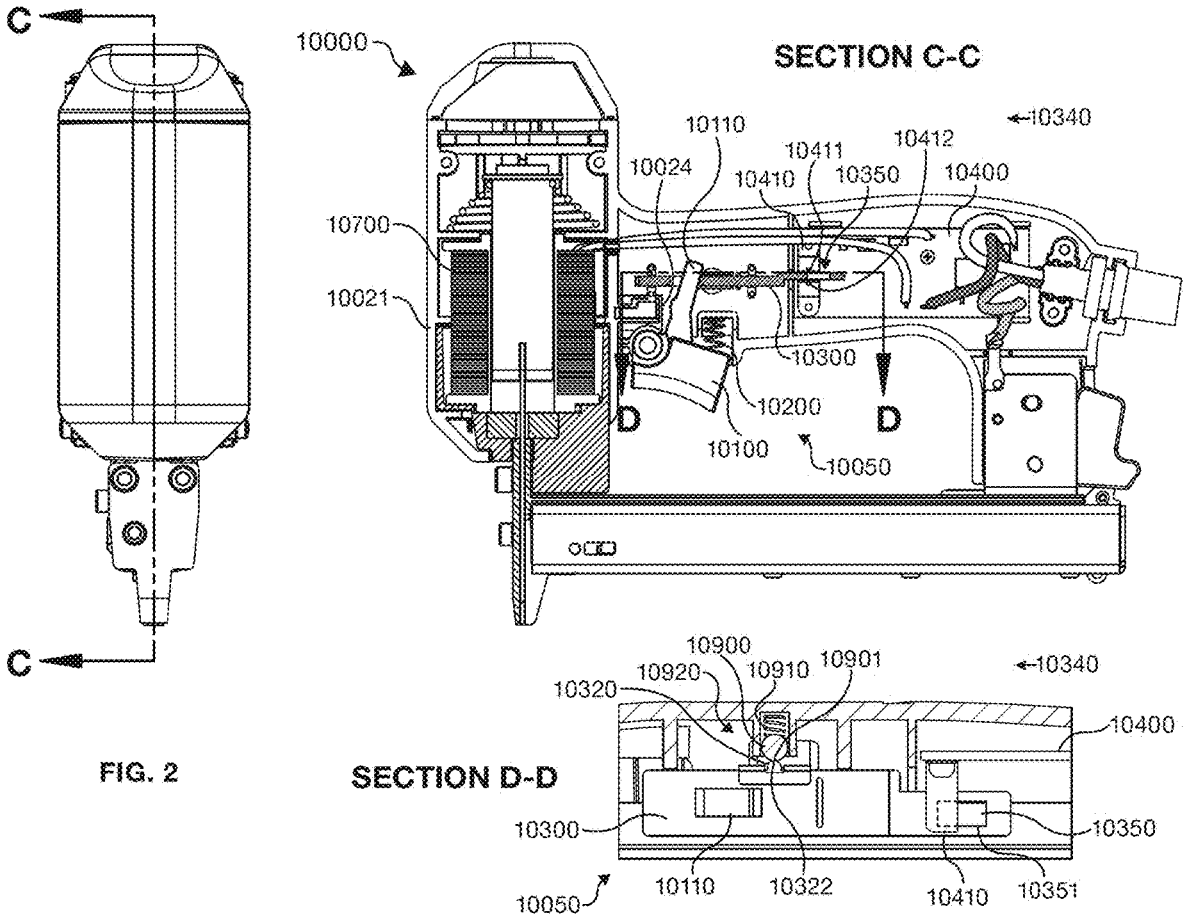
FIG. 2 is a diagram and partial section views of the electric carpet stapler of FIG. 2 at the actuation, in accordance with an embodiment of the invention.

10100 (FIG. 1) is pulled, trigger arm 10110 rotates counter-clockwise and pulls slider 10300 in the pulling direction of arrow 10340, but not to a point where aperture 10350 causes a change of state of photo sensor 10410 (to be described below). This pulling motion in the direction of arrow 10340 also causes a forward section 10321 of rounded projection 10320 to contact ball 10900. Gradually, rounded projection 10320 lifts ball 10900 up forward section 10321, but not up to apex 10322 (which is shown in FIG. 2, Section D-D). This motion biases ball spring 10910. Furthermore, as shown in Section A-A, as soon as trigger 10100 is pulled from the trigger starting position 10121, trigger return spring 10200 is biased, putting force on trigger 10100 to move back in the clockwise direction. Therefore, at any point during pre-actuation, if trigger 10100 is released, trigger 10100 will move in the clockwise direction, and slider 10300 will move in the reset direction of arrow 10380, and there will be no change of state of photo sensor 10410.

FIG. 2 shows a section C-C of the electric carpet stapler 10000 with trigger and switch assembly 10050 at the actuation. The counter-clockwise rotation of trigger 10100 has moved slider 10300 to its position at the actuation. Section D-D shows trigger and switch assembly 10050 from the top of slider 10300. As shown in Section C-C, as slider 10300 is pulled in the pulling direction of arrow 10340, aperture 10350 moves to permit light to pass from the light emitter 10411 of photo sensor 10410 to light sensor 10412, causing a change of state of the photo sensor 10410, from a sensor signal-on state to a sensor signal-off state which signals the control circuit 10400 to begin a process to supply power to the winding 10700. During that same motion of slider 10300, as shown in Section D-D, rounded projection 10320 also moves in the pulling direction of arrow 10340, causing the apex 10901 of ball 10900 to reach and contact the apex 10322 of rounded projection 10320.

Figure 3:
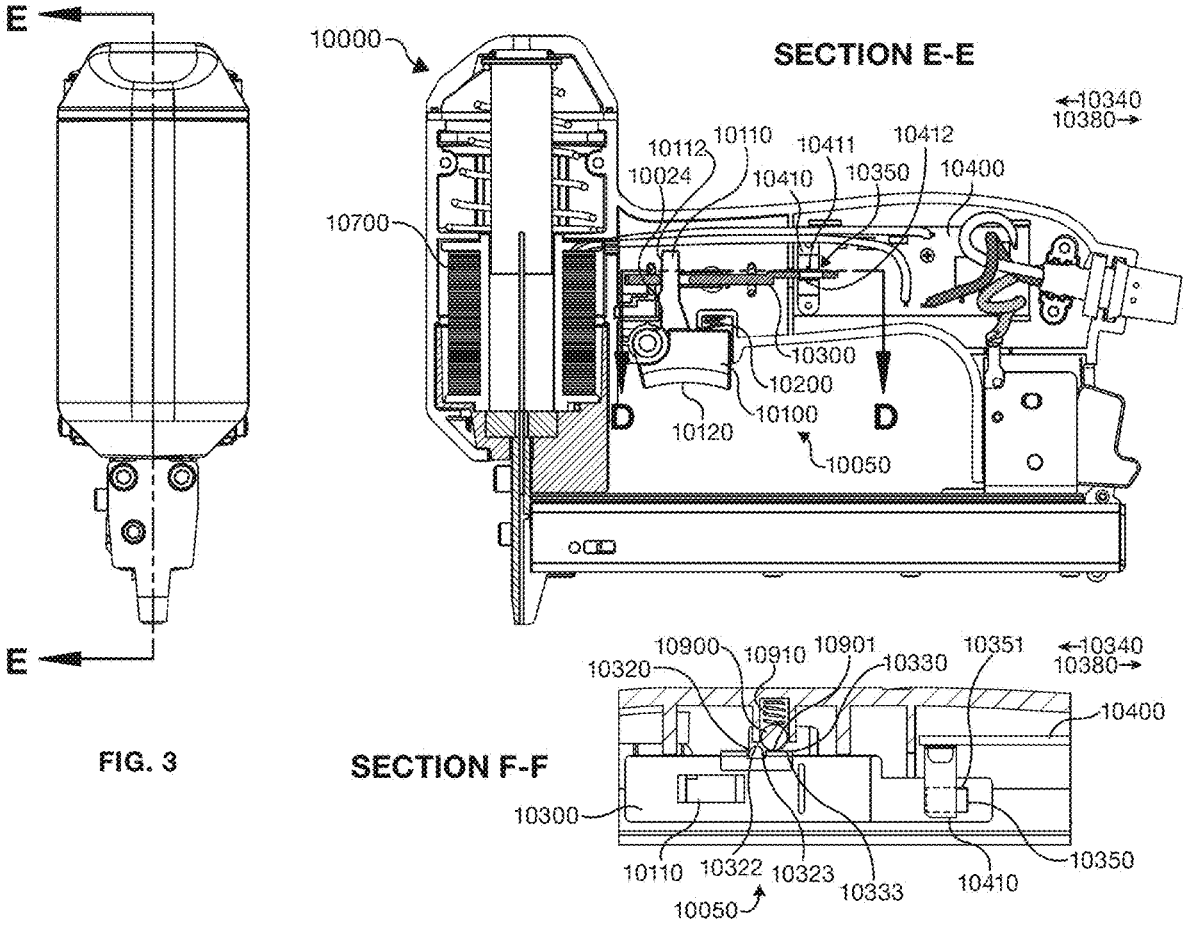
FIG. 3 is a diagram and partial section views of the electric carpet stapler of FIG. 3 in the post-actuation, in accordance with an embodiment of the invention.

After the actuation, Section E-E of FIG. 3 shows trigger and switch assembly 10050 of electric carpet stapler 1000 at the post-actuation. Pressure from the user's finger on trigger surface 10120 causes trigger 10100 to continue to rotate counter-clockwise and pull slider 10300 in the pulling direction of arrow 10340. Section F-F of Section E-E shows trigger and switch assembly 10050 from the top of slider 10300. Almost instantaneously after the actuation, as the apex 10322 of rounded projection 10320 moves past the apex 10901 of ball 10900, the steep downward slope of the trailing section 10323 of rounded projection 10320 permits ball 10900 to be rapidly accelerated by ball spring 10910 and impact metal sleeve 10330 at trailing surface 10333. The impact of ball 10900 on metal sleeve 10330 produces haptic feedback in the form of a click that a user can associate with the actuation. These motions of trigger and switch assembly 10050 producing the click are mechanical and occur even if power is not connected. As such, the click in the trigger and switch assembly 10050 is beneficial in training a user to use electric carpet stapler 10000 (Section E-E), which should occur with power disconnected. As shown in Section E-E, in the post-actuation, the user can continue pulling trigger 10100 until the front side 10112 of trigger arm 10110 contacts the trigger stop 10024, which provides some travel for a natural motion of the trigger finger.

In the post-actuation, as shown in Section E-E, because of the length 10351 (Section F-F) of aperture 10350, light continues being permitted to pass from the light emitter 10411 of to the light sensor 10412 of photo sensor 10410, causing no change of state of photo sensor 10410. As a result, during the post-actuation, photo sensor 10410 cannot have a change of state or send a second signal to the control circuit 10400 to begin a process to supply power to the winding 10700 (Section E-E) a second time.

As shown in Section E-E of FIG. 3, by the post-actuation, trigger 10100 has strongly biased trigger return spring 10200. As the user releases the trigger 10100, the bias of trigger return spring 10200 ensures that trigger 10100 and trigger arm 10110 will rotate back in the clockwise direction, causing slider 10300 to move in the reset direction connoted by arrow 10380. These motions continue until the elements return to their positions in Section A-A of FIG. 1. As shown in Section A-A of FIG. 1, aperture 10350 of slider 10300 passes beyond light emitter 10411 and blocks light from passing to the light sensor 10412, producing another change of state of a photo sensor 10410 that produces the sensor sensor-on signal to the control circuit 10400, which resets the control circuit 10400 to receive a next sensor signal-off signal for a next actuation. However, as shown in Section C-C of FIG. 2, no such actuation can occur until the trigger is again pulled by a user to the trigger point of actuation 10123 (Section G-G of FIG. 4).

At the actuation, as shown in Section C-C of FIG. 2, features of trigger and switch assembly 10050 ensure that, for any one pulling of trigger 10100, there will only be at most one actuation due to one change of state of photo sensor 10410 to the sensor signal-off state that comprises a signal to the control circuit 10400 to begin a process to supply power to the winding 10700. By the actuation, trigger 10100 has been pulled in a counter-clockwise direction, and return spring 10200 is biased. At the actuation, as shown in Section D-D, slider 10300 has moved to position the apex 10322 of rounded projection 10320 in contact with the apex 10901 of ball 10900, biasing ball spring 10910, and creating a mechanical instability. At the mechanical instability, as shown in Section C-C, trigger 10100 is required to move, either by being pulled counter-clockwise by a user up the point that trigger arm 10110 contacts the trigger stop 10024, in which case the length 10351 (Section D-D) of aperture 10350 (Section D-D) continues permitting light to pass to pass, resulting in no change of state in photo sensor 10410, or else if trigger 10100 is released, it is required to move clockwise towards the trigger starting position 10121 (Section A-A of FIG. 1) of the pre-actuation due to the bias of return spring 10200. As shown in Section A-A of FIG. 1, when trigger 10100 moves clockwise, slider aperture 10350 of slider 10300 moves to prevent light from passing from the light emitter 10411 of the photo sensor 10410 to the light sensor 10412, causing a change of state of a photo sensor 10410 to a sensor signal-on state, producing a sensor signal-on signal on the conductor to the control circuit, resetting the control circuit to receive a next sensor signal-off signal. At any point of the pre-actuation, whether trigger 10100 is pulled or released, there will also be no change in state of photo sensor 10410 from the sensor signal-on state, because slider 10300 will not be moved far enough in the pulling direction of arrow 10340 for aperture 10350 to permit light through. For these reasons, any motion of trigger 10100 by a user should at most cause the control circuit 10400 to begin a process to supply power to winding 10700 one time only.

As shown in Section E-E of FIG. 3, if left to its own in a reset that occurs after an actuation, the trigger and switch assembly 10050 should be able to change photo sensor 10410 only from the sensor signal-off state to the sensor signal-on state. Once the user pulls the trigger 10100 far enough counter-clockwise past the trigger point of actuation, where photo sensor 10410 produces the sensor signal-off state, trigger return spring 10200 is biased to turn trigger 10100 back in the clockwise direction to the trigger starting position 10121 (FIG. 1, Section A-A) of the pre-actuation. Once reaching the pre-actuation, as shown in Section A-A of FIG. 1, trigger 10100 has moved slider 10300 and aperture 10350 so that light from photo sensor 10410 is prevented from passing from light emitter 10411 of the photo sensor 10410 to the light sensor 10412, and photo sensor 10410 can change only from the sensor signal signal-off state to the sensor signal signal-on state. As shown in Section B-B of FIG. 1, moving trigger 10100 (Section A-A) to a trigger starting position 10121 (Section A-A) causes ball 10900 to no longer contact rounded projection 10320 of slider 10300.

As shown in Section G-G of FIG. 4, the electric carpet stapler 10000 has a housing 10020 that generally has a handle portion 10025 with a horizontal axis 10026. Slider 10300 moves in a horizontal axis 10026 of the handle portion 10025. Photo sensor 10410 includes an opening 10413 for the slider 10300 in the horizontal axis of the handle. In one embodiment, photo sensor 10410 is positioned at a portion 10401 of the control circuit 10400 proximate the trigger 10100.

Figure 6:
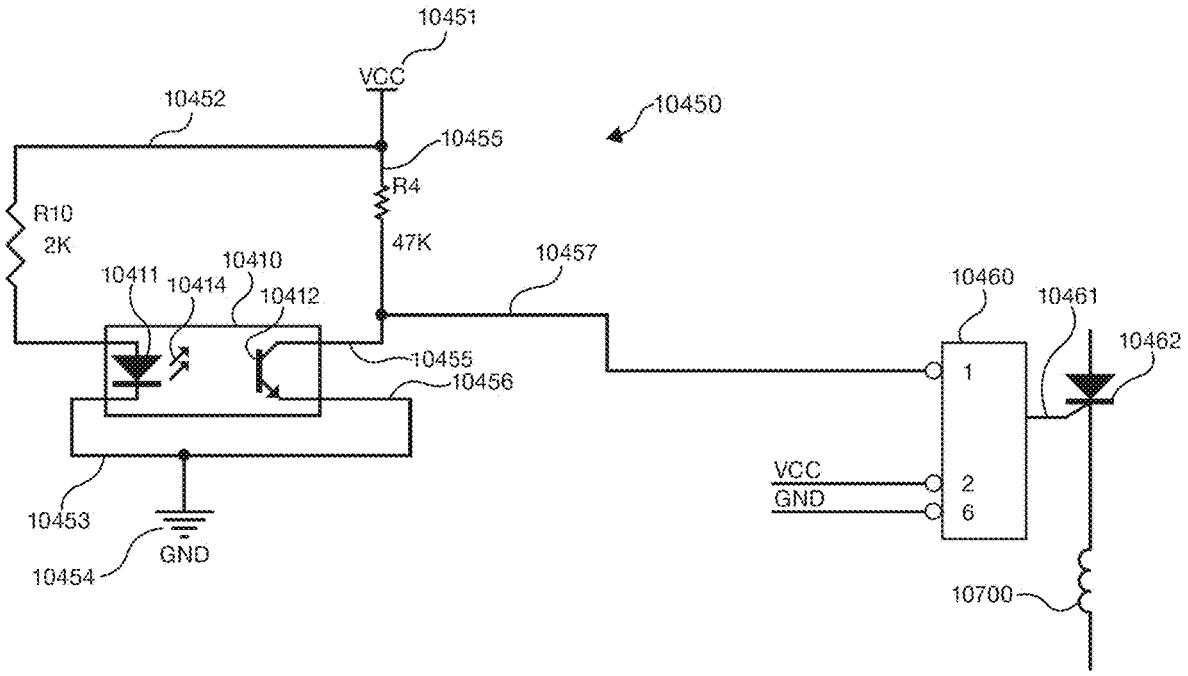
FIG. 6 is a circuit diagram of an embodiment of a control circuit, in accordance with an embodiment of the invention.

FIG. 6 shows a simplified circuit diagram of an embodiment of a control circuit including a photo sensor circuit 10450 that produces the sensor signal off signal that causes a logic circuit 10460 to begin a process to supply power to the winding 10700. Photo sensor 10410 comprises a light emitter 10411 comprising a light emitting diode that emits infrared light, and a light sensor 10412 comprising a silicon photo transistor. Photo sensor 10410 is supplied by VCC 10451 on conductor 10452, which powers the light emitter 10411, and on conductor 10455, which powers light sensor 10412. At the actuation, light 10414 passing from light emitter 10411 contacts light sensor 10412 and causes light sensor 10412 to behave like a closed switch that conducts on conductor 10456 to ground 10454. This creates a signal on conductor 10457 to the logic circuit 10460 comprising a drop in voltage to near zero, referred to herein as a sensor signal-off signal. When the logic circuit 10460 detects the sensor signal-off signal, it begins the process to supply power to the winding 10700.

Afterwards, when the trigger is released the slider prevents light 10414 from light emitter 10411 from contacting light sensor 10412. This causes light sensor 10412 to behave like a switch that opens to cause a signal referred to herein as a sensor signal-on signal, comprising an increase in voltage on the conductor 10457 to the logic circuit 10460. This resets the logic circuit 10460 to receive a next sensor signal-off signal.

In one embodiment, logic circuit 10460 is a microchip programmed to sense changes in voltage on conductor 10457 and can supply a current on the gate 10461 to control a silicon-controlled rectifier 10462 to supply power to winding 10700. In alternative embodiments to the photo sensor circuit 10450, the light sensor 10412 conducts an alternative type of signal to the conductor to the control circuit, for example an increase in voltage that signals the logic circuit 10460 to begin a process to supply power to the winding.

Embodiments of the invention described herein employ an electronic sensor comprising a photo sensor that has a change of state in response to the motion of a sensor actuator. Other embodiments use other types of electronic sensors, including inductive sensors that create magnetic fields that when disturbed change the state of the sensor, or capacitive sensors that sense changes in capacitance. However, photo sensors advantageously provide low cost and very durable designs that can withstand vibration and that are also not affected by electrical interference produced by the winding.

Figure 5:
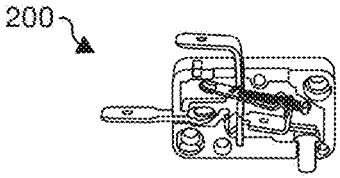
FIG. 5 shows a prior art microswitch.

As used herein, and as shown in FIG. 6, in one embodiment, the change of state in photo sensor 10410 that is caused by light 10414 passing from light emitter 10411 and contacting light sensor 10412, and that causes light sensor 10412 to behave like a switch that conducts on conductor 10456 to ground 10454, is an electronic change in state. Unlike the prior art mechanical microswitch 200 (FIG. 5), the electronic change of state in photo sensor 10410 is caused by an electronic change of photo sensor 10410, in this case a change in resistance, and not by a mechanical motion. Other embodiments using other types of electronic sensors may have other electronic changes in state. In some embodiments, a part of the electronic sensor is a semiconductor.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. An electric carpet stapler comprising:

a housing including a handle;

a winding within the housing;

an armature attached to a staple driver blade, the armature in communication with the winding such that the armature is magnetically forced to move the staple driver blade to drive a staple upon supply of power of the winding;

a trigger;

a sensor actuator coupled to the trigger, the sensor actuator moveable by the trigger;

a photo sensor having a change of state caused by movement of the sensor actuator relative to the photo sensor;

a control circuit configured to receive a signal caused by the change in state of the photo sensor, where the signal causes the control circuit to begin a process to supply power to the winding;

a toggle mechanically coupled to the trigger, where the trigger rotates on a pivot from a trigger starting position to a trigger point of actuation, and when the trigger rotates to the trigger point of actuation, the toggle creates a mechanical instability requiring the trigger to rotate either towards the trigger starting position or to rotate further past the trigger point of actuation; and a ball having an apex, and wherein the sensor actuator comprises a slider that is moved by the trigger, and the slider includes the toggle comprising a rounded projection having an apex, wherein the mechanical instability is caused by the apex of the rounded projection being in contact with the apex of the ball.

2. The electric carpet stapler of claim 1, wherein the sensor actuator comprises a slider that permits or prevents light to pass from a photo sensor light emitter to a light sensor of the photo sensor.

3. The electric carpet stapler of claim 2, wherein the slider includes a slider aperture that permits light to pass from the photo sensor light emitter to the light sensor of the photo sensor.

4. The electric carpet stapler of claim 2, wherein when light passes from the photo sensor light emitter to the light sensor of the photo sensor, the photo sensor has the change of state.

5. The electric carpet stapler of claim 2, wherein the trigger rotates on a pivot to move the slider, and the slider is configured to permit or prevent light to pass from the photo sensor light emitter to the light sensor of the photo sensor as the slider is moved by the trigger.

6. The electric carpet stapler of claim 1, wherein the change of state of the photo sensor causes a sensor signal-off signal comprising a drop in voltage on a conductor that couples the photo sensor to the control circuit, and the control circuit responds to the drop in voltage on the conductor by beginning the process to supply power to the winding.

7. The electric carpet stapler of claim 1, wherein after the photo sensor has the change of state that causes the control circuit to begin the process to supply power to the winding, the photo sensor has another change of state that causes an increase in voltage on the conductor to the control circuit, causing the control circuit to reset to respond to another sensor signal-off signal.

8. The electric carpet stapler of claim 1, wherein the sensor actuator comprises a slider that prevents light from passing from a photo sensor light emitter to a light sensor of the photo sensor.

9. The electric carpet stapler of claim 1, wherein the change of state in the photo sensor and the mechanical instability occur at the trigger point of actuation.

10. The electric carpet stapler of claim 1, further comprising:

a trigger return spring that is biased as the trigger is rotated from the trigger starting position.

11. The electric carpet stapler of claim 1, wherein the toggle provides haptic feedback when the trigger is depressed and even when the electric carpet stapler is not connected to power.

12. The electric carpet stapler of claim 1, further including a ball spring producing a pressure on the ball causing the ball to contact the rounded projection.

13. The electric carpet stapler of claim 1, wherein the sensor actuator is moved by the trigger along a first axis within the handle, wherein the handle is oriented orthogonally with respect to the armature.

14. The electric carpet stapler of claim 13, wherein the photo sensor includes a sensor opening for the sensor actuator along the first axis.

15. The electric carpet stapler of claim 1, wherein the photo sensor is an electronic component of the control circuit.

16. The electric carpet stapler of claim 1, wherein the photo sensor is an electronic sensor.

17. An electric carpet stapler, comprising:

a trigger that is rotatable on a pivot from a trigger starting position to a trigger point of actuation;

a slider coupled to the trigger to move when the trigger is rotated, the slider including a rounded projection and an apex;

a ball having an apex;

a photo sensor that has a change in state when the slider permits or prevents light from passing from a photo sensor light emitter to a photo sensor light sensor;

a control circuit coupled to detect the change of state of the photo sensor, the control circuit configured to begin a process to supply power to a winding in response to detecting the change in state of the photo sensor;

wherein when the trigger rotates from the trigger starting position to the trigger point of actuation, the trigger moves the slider to permit or prevent light from passing from the photo sensor light emitter to the photo sensor light sensor, causing the photo sensor to have the change in state causing the control circuit to begin the process to supply power to the winding, and the trigger moves the rounded projection of the slider to move the apex of the rounded projection into contact with the apex of the ball.

18. The electric carpet stapler of claim 17, further comprising:

a trigger stop, wherein as the trigger rotates from the trigger point of actuation to the trigger stop, the slider allows light to pass from the photo sensor light emitter to the photo sensor light sensor.

19. The electric carpet stapler of claim 17, further comprising:

a ball spring, wherein when the trigger moves past the trigger point of actuation, the ball is urged by the ball spring to impact a surface.

20. The electric carpet stapler of claim 19, wherein the impact of the ball against the surface produces a mechanical click when the electric carpet stapler is not connected to power.

21. The electric carpet stapler of claim 19, further comprising:

a metal sleeve mounted on the slider, wherein the ball impacts the surface on the metal sleeve.

* * * * *